US006442804B2

(12) United States Patent
Turvey et al.

(10) Patent No.: US 6,442,804 B2
(45) **Date of Patent: *Sep. 3, 2002**

(54) RECLOSABLE FASTENER ASSEMBLY WITH SLIDER CLOSED POSITION INDICATOR

(75) Inventors: Robert R. Turvey, Midland County, MI (US); Douglas A. Soller, Racine County, WI (US); Jeffrey J. Christensen, Milwaukee County, WI (US); Douglas P. Gundlach, Racine County, WI (US)

(73) Assignee: S. C. Johnson Home Storage, Inc., Racine, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,022

(22) Filed: Nov. 4, 1999

(51) Int. Cl.[7] ..... A44B 19/16; B65D 33/08

(52) U.S. Cl. ..... 24/399; 24/400; 24/390; 24/433; 24/587

(58) Field of Search ..... 24/399, 400, 433, 24/390, 587; 350/105

(56) References Cited

U.S. PATENT DOCUMENTS

| | | | | |
|---|---|---|---|---|
| 3,173,184 | A | 3/1965 | Ausnit | 24/201 |
| 3,660,875 | A | 5/1972 | Gutman | |
| 4,186,786 | A | 2/1980 | Kirkpatrick | |
| 4,262,395 | A | 4/1981 | Kosky | 24/201 C |
| 4,285,105 | A | 8/1981 | Kirkpatrick | |
| 4,756,061 | A * | 7/1988 | Jones et al. | 24/433 |
| 4,786,190 | A | 11/1988 | Van Erden et al. | |
| 4,829,641 | A | 5/1989 | Williams | 24/587 |
| 4,907,321 | A | 3/1990 | Williams | 24/587 |
| 5,007,143 | A | 4/1991 | Herrington et al. | 24/400 |
| 5,010,627 | A | 4/1991 | Herrington et al. | 24/400 |
| 5,064,664 | A | 11/1991 | Hustad | |
| 5,067,208 | A | 11/1991 | Herrington, Jr. et al. | 24/400 |
| 5,088,971 | A | 2/1992 | Herrington | 493/203 |
| 5,103,979 | A | 4/1992 | Hustad | |
| 5,131,121 | A | 7/1992 | Herrington, Jr. et al. | 24/436 |
| 5,138,750 | A | 8/1992 | Gundlach et al. | 24/587 |
| 5,140,727 | A | 8/1992 | Dais et al. | 24/587 |
| 5,161,286 | A | 11/1992 | Herrington, Jr. et al. | 24/387 |
| 5,189,764 | A | 3/1993 | Herrington et al. | 24/387 |
| 5,248,201 | A | 9/1993 | Kettner et al. | |
| 5,272,793 | A * | 12/1993 | Wilk | 24/390 |
| 5,283,932 | A | 2/1994 | Richardson et al. | 24/400 |
| 5,301,394 | A | 4/1994 | Richardson et al. | 24/399 |
| 5,301,395 | A | 4/1994 | Richardson et al. | 24/400 |
| 5,356,222 | A | 10/1994 | Kettner et al. | 383/63 |

(List continued on next page.)

FOREIGN PATENT DOCUMENTS

| | | |
|---|---|---|
| WO | 98/50278 | 11/1998 |
| WO | 98/50280 | 11/1998 |
| WO | 00/64766 | 1/2000 |
| WO | 00-64767 | 11/2000 |
| WO | 00/71433 | 11/2000 |
| WO | 01/14213 | 3/2001 |
| WO | 01/14217 | 3/2001 |

*Primary Examiner*—Victor N. Sakran

(57) ABSTRACT

A reclosable fastener assembly includes first and second elongated closure elements that are engageable to form a seal. A slider is slidable relative to the closure elements between an open position and a closed position and is adapted (i) to engage the closure elements to one another when moved across the closure elements toward the closed position and (ii) to disengage the closure elements from one another when moved across the closure elements toward the open position. The slider carries a first partial indicator. A second partial indicator is located relative to the closure elements so as to complement the first partial indicator to form a visual indicator when the slider is in the closed position.

24 Claims, 5 Drawing Sheets

U.S. PATENT DOCUMENTS

| | | | | |
|---|---|---|---|---|
| 5,405,478 | A | 4/1995 | Richardson et al. | 156/308.4 |
| 5,431,760 | A | 7/1995 | Donovan | 156/66 |
| 5,442,837 | A | 8/1995 | Morgan | 24/400 |
| 5,448,807 | A | 9/1995 | Herrington, Jr. | 24/399 |
| 5,470,156 | A | 11/1995 | May | 383/210 |
| 5,474,382 | A | 12/1995 | May | 383/211 |
| 5,486,051 | A | 1/1996 | May | 383/200 |
| 5,489,252 | A | 2/1996 | May | 383/210 |
| 5,509,735 | A | 4/1996 | May | 383/210 |
| 5,513,915 | A | 5/1996 | May | 383/210 |
| 5,527,112 | A | 6/1996 | Dais et al. | 383/211 |
| 5,551,127 | A | 9/1996 | May | 24/30.5 |
| 5,564,834 | A | 10/1996 | Porchia et al. | 383/211 |
| 5,647,671 | A | 7/1997 | May | 383/210 |
| 5,669,715 | A | 9/1997 | Dobreski et al. | 383/5 |
| 5,681,115 | A | 10/1997 | Diederich et al. | 383/64 |
| 5,697,130 | A | * 12/1997 | Smith | 24/383 |
| 5,713,669 | A | 2/1998 | Thomas et al. | 383/204 |
| 5,722,128 | A | 3/1998 | Toney et al. | 24/400 |
| 5,774,955 | A | 7/1998 | Borchardt et al. | 24/587 |
| 5,775,812 | A | 7/1998 | St. Phillips et al. | 383/5 |
| 6,135,636 | A | 10/2000 | Randall | 383/64 |

* cited by examiner

RECLOSABLE FASTENER ASSEMBLY WITH SLIDER CLOSED POSITION INDICATOR

FIELD OF THE INVENTION

The present invention relates to reclosable fastener assemblies, such as the kind that is useful for sealing thermoplastic bags. More specifically, the present invention relates to such a fastener assembly which employs a slider by which the fastener assembly is opened and closed, and which provides a visual indicator of when the slider is in its closed position.

BACKGROUND OF THE INVENTION

Reclosable fastener assemblies are well known in the art, most commonly for use in sealing thermoplastic bags. Such fastener assemblies often include a pair of opposing, engageable closure elements that can be pressed together to form a seal and subsequently pried apart to release the seal. In many such fastener assemblies, commonly referred to as "zippers," the closure elements are complementary profiles that interlock when pressed together.

Some typical fastener assemblies are illustrated in U.S. Pat. No. 5,140,720 (interlocking rib and groove elements), U.S. Pat. No. 5,007,143 (rolling action zipper profile), and U.S. Pat. No. 3,173,184 (profiles having alternating hook-shaped closure elements).

Some fastener assemblies include a slider to facilitate engaging and disengaging of the closure elements. The slider rides on the closure elements, and, depending on the direction the slider is moved along the closure elements, the fastener assembly is either opened or closed. A typical slider brackets the closure elements and is configured so as to clamp the closure elements together when moved in one direction and to pry the closure elements apart when moved in the other direction. In some embodiments, the slider will include a separating element that fits between the closure elements in order to pry them apart. Such separating elements are illustrated in U.S. Pat. Nos. 4,262,395 (arrowhead-shaped separating element); 5,007,143 (tapered separating element); 3,173,184 (v-shaped separating element) and 5,067,208 (key-hole shaped separating element).

Certain reclosable fastener assemblies provide tactile and/or audible feedback as the slider moves across the closure elements. These typically involve detents or deformations in the closure elements that affect the feel and/or sound the closure elements produce as they are interlocked, such as in U.S. Pat. Nos. 5,138,750 and 5,722,128, or closure elements that elastically deform when interlocked, such as in U.S. Pat. No. 5,774,955. The former type provides feedback while the slider is being moved, but no real indication as to whether the fastener assembly is closed or open once the slider is at an end of the closure elements. The latter type does provide an indication of when the fastener assembly is closed, but that indication is rather subtle.

Other reclosable fastener assemblies provide visual feedback when the closure elements are engaged. These typically involve providing colored closure elements that combine to produce a color change when the closure elements are interlocked. Some examples are illustrated in U.S. Pat. Nos. 4,829,641; 4,907,321 and 5,356,222. Unless the closure profiles are sufficiently separated, this arrangement is only helpful when the user remembers which color indicates an open position of the closure elements.

Thus, it is not always easy for a user to tell at a glance whether a fastener assembly is closed or open. This is especially true for fastener assemblies that employ sliders, because the action of the slider typically does not separate the closure elements far enough that it is visually obvious when the fastener is open. Therefore, there is a need in the art for a reclosable fastener assembly, employing a slider, whereby a visual indicator is provided as to whether the slider is in its fully closed position.

SUMMARY OF THE INVENTION

The reclosable fastener assembly of the present invention addresses the foregoing needs in the art by providing complementary partial indicators that combine to form a visual indicator when the slider is in the closed position.

According to one aspect, the present invention relates to a reclosable fastener assembly, including first and second elongated closure elements engageable to form a seal. A slider is slidable relative to the closure elements between an open position and a closed position and is adapted (i) to engage the closure elements to one another when moved across the closure elements toward the closed position and (ii) to disengage the closure elements from one another when moved across the closure elements toward the open position. The slider carries a first partial indicator. A second partial indicator is located relative to the closure elements so as to complement the first partial indicator to form a visual indicator when the slider is in the closed position.

Preferably, the second partial indicator is stationary relative to the closure elements. Generally, the second partial indicator is located near an end of the closure elements.

The first and second partial indicators can comprise complementary portions of a pattern. The pattern can be a word, in which case the first and second partial indicators can include complementary portions of individual letters of the word. The pattern can also depict an object, which can be three dimensional.

A stop can be disposed so that the slider abuts the stop when the slider is in the closed position, and the second partial indicator can be provided on the stop.

Alternatively, the slider can include an opening through a side of the slider, and the second partial indicator can comprise a visible feature that is located so as to be visible through the opening of the slider when the slider is in the closed position. A pair of the openings can be provided, one each through opposite sides of the slider, in which case a pair of the visible features can be provided, each located so as to be visible through a different one of the pair of the openings of the slider when the slider is in the closed position. The feature can be provided on the surface of one of the closure elements, and can be a pigmented spot, for example.

According to another aspect, the present invention relates to a reclosable fastener assembly for selectively closing a mouth of a thermoplastic bag. The fastener assembly includes first and second elongated closure profiles disposed on opposing surfaces of the mouth of the bag. The first and second closure profiles are interlockable to seal the mouth of the bag. A slider brackets the closure profiles, and is slidable relative to the closure profiles between an open position and a closed position. The slider is adapted (i) to interlock the closure profiles when moved across the closure profiles toward the closed position and (ii) to disengage the closure profiles from one another when moved across the closure profiles toward the open position. The slider carries a first partial indicator. A second partial indicator is disposed relative to the closure profiles so as to combine with the first partial indicator to form a visual indicator when the slider is in the closed position.

These and other objects, features and advantages of the present invention will be more apparent from the following description of the preferred embodiments, with reference to the following drawings, in which like reference numerals refer to like elements throughout.

DETAILED DESCRIPTION OF THE PREFERRED EMBODIMENTS

Figure 1A:
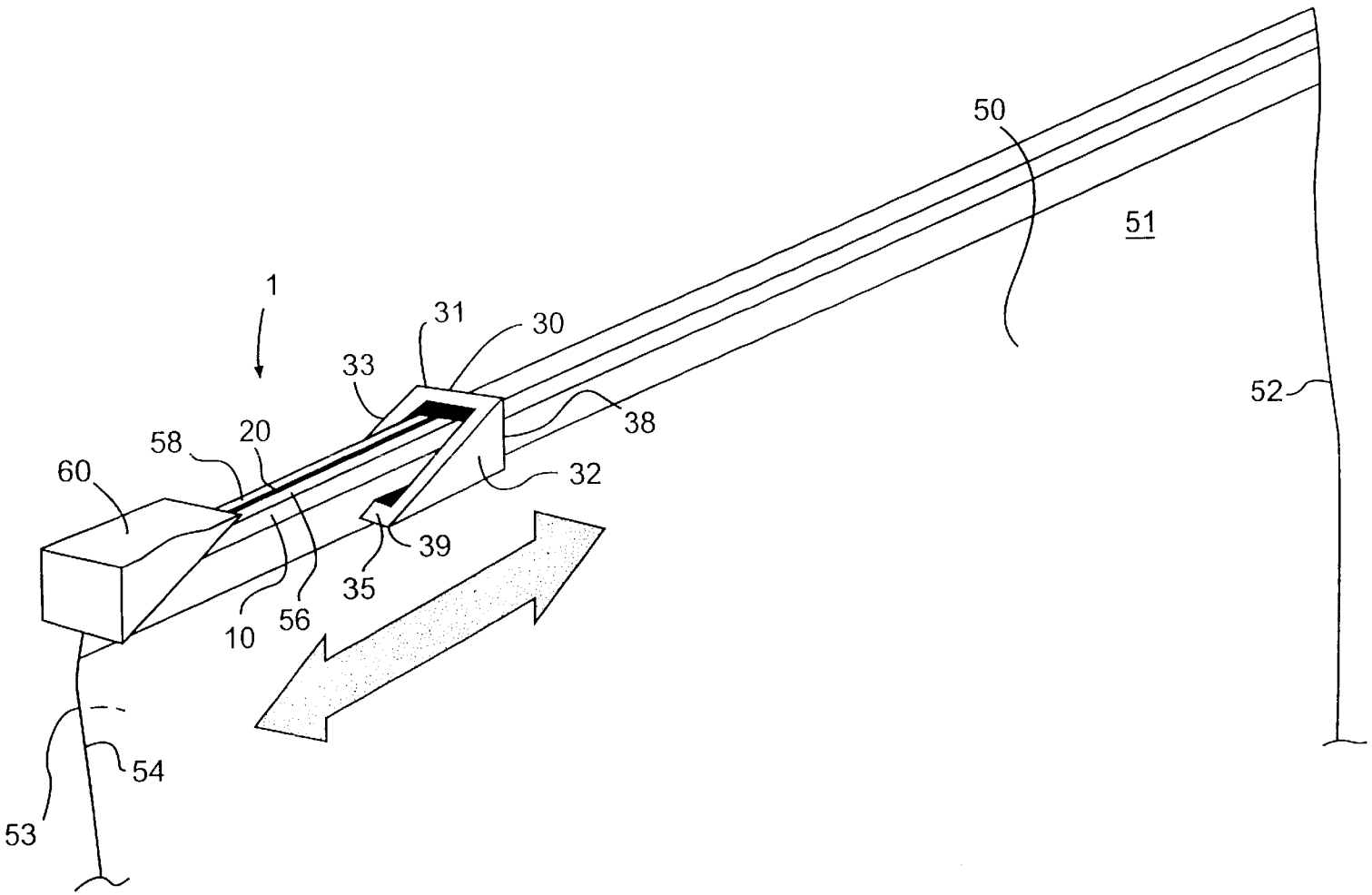
FIG. 1A is a partial perspective view of a thermoplastic bag employing a reclosable fastener assembly according to an embodiment of the present invention.
Figure 1B:
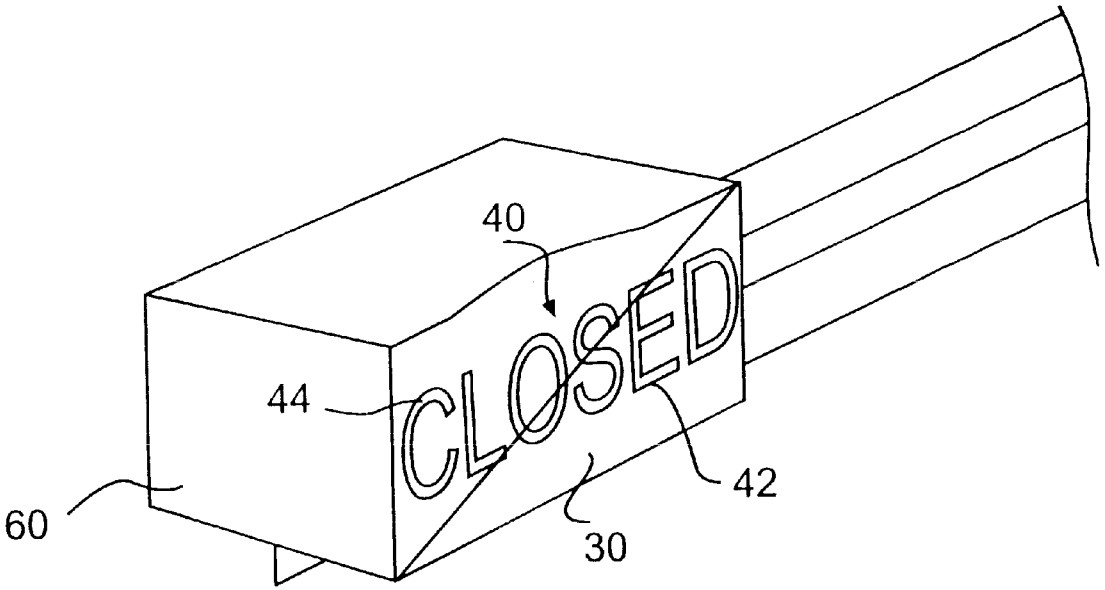
FIG. 1B is a detailed perspective view of an aspect of the fastener assembly illustrated in FIG. 1, in a closed position.

FIGS. 1A and 1B illustrate a reclosable fastener assembly 1 according to an embodiment of the present invention. The fastener assembly 1 includes first and second elongated closure elements 10, 20 that are engageable to form a seal. A slider 30, which can slide relative to the closure elements 10, 20 between a closed position (illustrated in FIG. 1B) and a fully open position (at the opposite end of the closure elements 10, 20), is adapted to promote engagement between the closure elements 10, 20 when moved across the closure elements 10, 20 toward its closed position, and disengage the closure elements 10, 20 from one another when moved across the closure elements toward its open position. The fastener assembly includes first and second partial indicators 42, 44, which are visible features that complement one another to form a visual indicator 40 when the slider 30 is in its closed position. The first partial indicator 42 is provided on the slider 30. The second partial indicator 44 is provided separate from the slider 30 and is positioned so as to complement the first partial indicator 42 and to form the visual indicator 40 when the slider 30 is moved to its closed position.

The reclosable fastener assembly 1 is useful, for example, for selectively closing the mouth of a thermoplastic bag 50. A typical thermoplastic bag 50 is formed of an opposing pair of flexible plastic sheets 51, 53, sealed together along a bottom (not shown) and two opposing side edges 52, 54. The top edges 56, 58 of the bag 50 are not sealed together, thereby forming an open mouth (to which the closure elements are affixed). The plastic sheets 51, 53 are typically made from any suitable thermoplastic film. Examples of suitable materials include low density polyethylene, linear low density polyethylene, substantially linear copolymers of ethylene, polypropylene, polyvinylidene chloride, other thermoplastic polymers, and blends of two or more of these. Pigment(s), ethylene vinyl acetate (for enhanced clarity), or the like, are often added.

The closure elements 10, 20 typically comprise complementary profiles, facing one another, which can be interlocked substantially across their entire length to form a seal. The closure elements 10, 20 are engaged to one another by pressing them together. The closure elements 10, 20 are affixed to or near the top edges, 56, 58, respectively, of the plastic sheets 51, 53 of the bag 50 and face one another. The closure elements 10, 20 can be extruded separately and attached to the bag, or can be extruded integrally with the sheets forming the bag. The closure elements can take any of several forms known in the art, including profiles such as those noted above, shown in U.S. Pat. Nos. 5,140,720; 5,007,143 and 3,173,184.

As noted, the closure elements 10, 20 are engaged to and disengaged from one another by action of the slider 30. The construction and operation of the slider 30, insofar as it interacts with the closure elements 10, 20 to open and to close the fastener assembly 1, are not critical to the present invention and can take any suitable form. One suitable slider is illustrated in U.S. Pat. No. 5,722,128, incorporated herein by reference in its entirety.

The slider 30 will typically have a generally inverted U-shaped profile, with a top 31 that straddles across the closure elements and sides 32, 33 that depend from the top, one to either side of the closure elements 10, 20. At least a portion of the closure elements is bracketed by the sides 32, 33 of the slider. Typically, ridges 35 project inwardly from each side 32, 33 of the slider 30. The ridges 35 help to maintain the slider 30 on the closure elements 10, 20, and can assist in pressing the closure elements 10, 20 into engagement. The outer surfaces of the closure elements 10, 20 can be shaped to accommodate or provide a track for the ridges 35. The ridges 35 can extend substantially the entire length of the slider 30, or can be provided at either end of the slider 30.

Typically, the slider 30 will be tapered, so that either the sides 32, 33 or the ridges 35 are closer together at one end 38 (the "clamping" end) of the slider 30 than at the other end 39. As the slider 30 is moved toward its closed position, the clamping end 38 of the slider 30 trails. The closer spacing (between the sides 32, 33 or the ridges 35) acts to press the closure elements 10, 20 together, thereby forcing the closure elements 10, 20 to interlock.

A separating element (not shown) can depend from the top 31 between the sides 32, 33 of the slider. The separating element fits between the closure elements 10, 20. As the slider 30 is moved toward the fully open position, the separating element trails the clamping end 38 of the slider 30, so that the separating element pries the closure elements 10, 20 apart. As with the overall slider 30, the configuration of the separating element is not critical to the present invention.

The slider 30 can be formed in any suitable manner, including fabricating multiple parts which are secured together on the closure elements 10, 20 (by, for example, fusing, friction fitting, bondings, clamping, or the like), or a one-piece construction that is fit onto the closure elements. The slider 30 (or slider parts) can be formed using any suitable method, such as injection molding, and can be formed of any suitable material, such as, for example, polybutylene terephthalate, polypropylene, nylon, polystyrene, acetal, polyketone, high density polyethylene, polycarbonate, acrylonitrile butadiene styrene, or the like.

Optionally, a stop 60 can be provided at a position at which the slider 30 will abut the stop 60 when the slider 30 is in its closed position. This stop 60 can serve two functions. The stop 60 can prevent the slider 30 from sliding off the end of the closure elements 10, 20 once the slider 30 reaches its closed position. The stop 60 can also reinforce the edge 54 of the bag 50 and/or the ends of the closure elements 10, 20, thereby maintaining the sheets 51, 53 together at the edge 54 of the bag and/or the closure elements 10, 20 together at their ends. A similar stop (not shown) can be provided at the opposite end of the closure elements 10, 20 for the same reasons. The end stops 60 also provide a user with a convenient grip when moving the slider 30.

The construction and securement of the stops 60 are not critical to the present invention, and can be done in any suitable manner. For example, the stops 60 can be riveted, clamped, molded or fused either to the sheets 51, 53 or to the closure elements 10, 20, or can be formed integrally with the closure elements 10, 20, generally in a post-extrusion process. Examples of suitable stops are illustrated in U.S. Pat. Nos. 5,067,208 (riveted-on clips); 5,088,971 (molded from surrounding fastener material); 5,131,121 (ultrasonically formed); 5,161,286 (clamped-on clips); 5,405,478 (bonded end stops); 5,442,837 (sealed ends of profiles) and 5,448,807 (melted-on clips).

As noted above, the slider 30 includes the first partial indicator 42. The first partial indicator 42 can be formed integrally with the slider 30, or can be affixed to the slider 30, as long as the first partial indicator 42 moves with the slider 30.

The second partial indicator 44 is disposed relative to the closure elements 10, 20 so as to combine with the first partial indicator 42 to form a visual indicator 40 when the slider 30 is in its closed position. The second partial indicator 44 should be stationary relative to the closure elements 10, 20, and is preferably located near the end of the closure elements 10, 20.

Figure 2A:
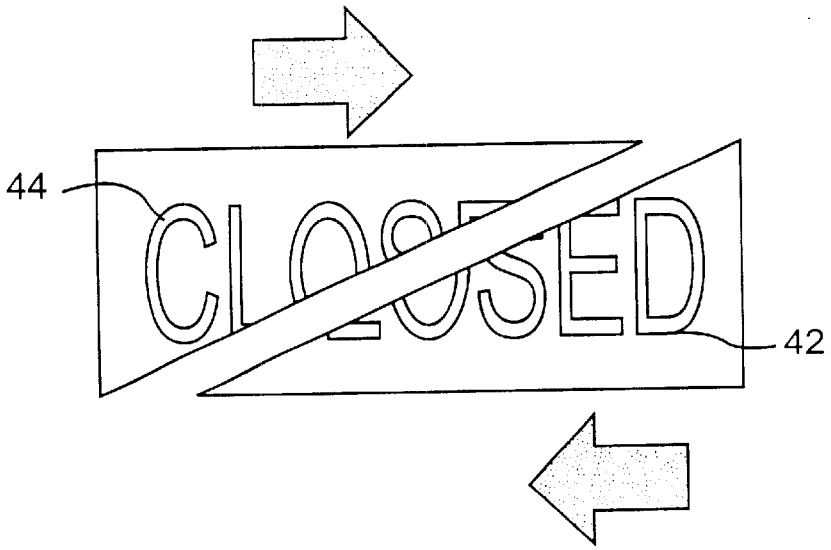
FIGS. 2A and 2B are schematic illustrations of partial indicators of a fastener assembly according to an embodiment of the present invention, in a partially open position and a closed position, respectively.
Figure 2B:
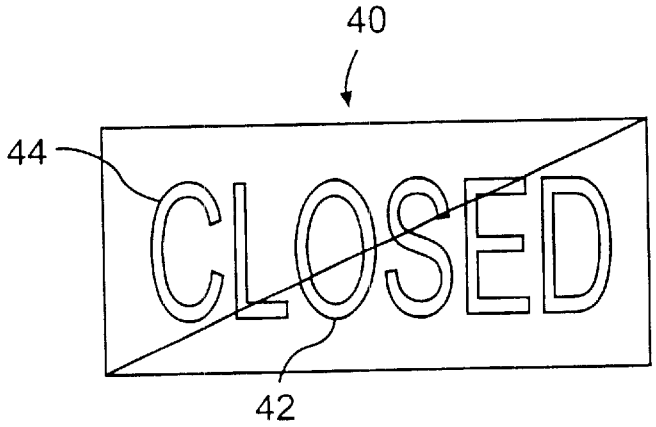
Figure 3A:
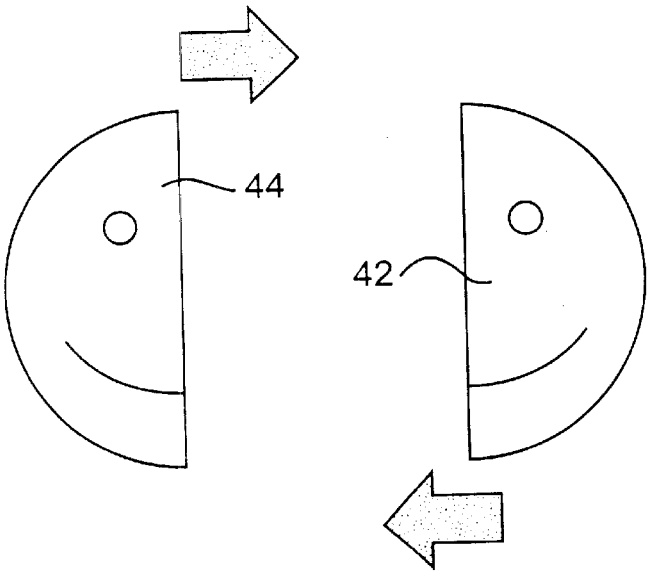
FIGS. 3A and 3B are schematic illustrations of partial indicators of a fastener assembly according to another embodiment of the fastener assembly of the present invention, in a partially open position and a closed position, respectively.
Figure 3B:
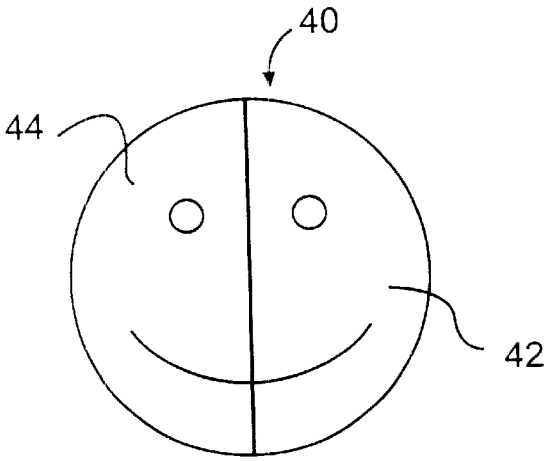

In the embodiment illustrated in FIGS. 1A and 1B, the first and second partial indicators 42, 44 provide complementary portions of a pattern. The actual content of the pattern is not crucial to the present invention, although it is preferred that the pattern be chosen and divided so as to provide a clear indication of when the visual indicator 40 is and is not formed. For example, the pattern can be a word. In the embodiment illustrated in FIGS. 2A and 2B, the pattern is the word "CLOSED" divided between the first and second partial indicators 42, 44. If the pattern is a word, it is preferred that the first and second partial indicators 42, 44 include complementary portions of an individual letter or individual letters of the word (as in the embodiment shown in FIGS. 2A and 2B), thereby further emphasizing the disconnect of the partial first and second partial indicators 42, 44 when the slider 30 is not in its closed position. In another embodiment, illustrated in FIGS. 3A and 3B, the pattern depicts an image or object. The image or object can be two- or three-dimensional, and if desired, a well-known animated character, symbol, or the like.

In the embodiments illustrated in FIGS. 1A–3B, in which the first and second partial indicators 42, 44 comprise complementary portions of a pattern, it is preferred that the second partial indicator 44 be provided on the stop 60 that is near the closed position of the slider 30. However, this is not necessary to the invention, and the second partial indicator 44 can be provided integrally with the closure elements 10, 20 or another part of the fastener assembly 1, or can be a separate element affixed to the fastener assembly.

Figure 4A:
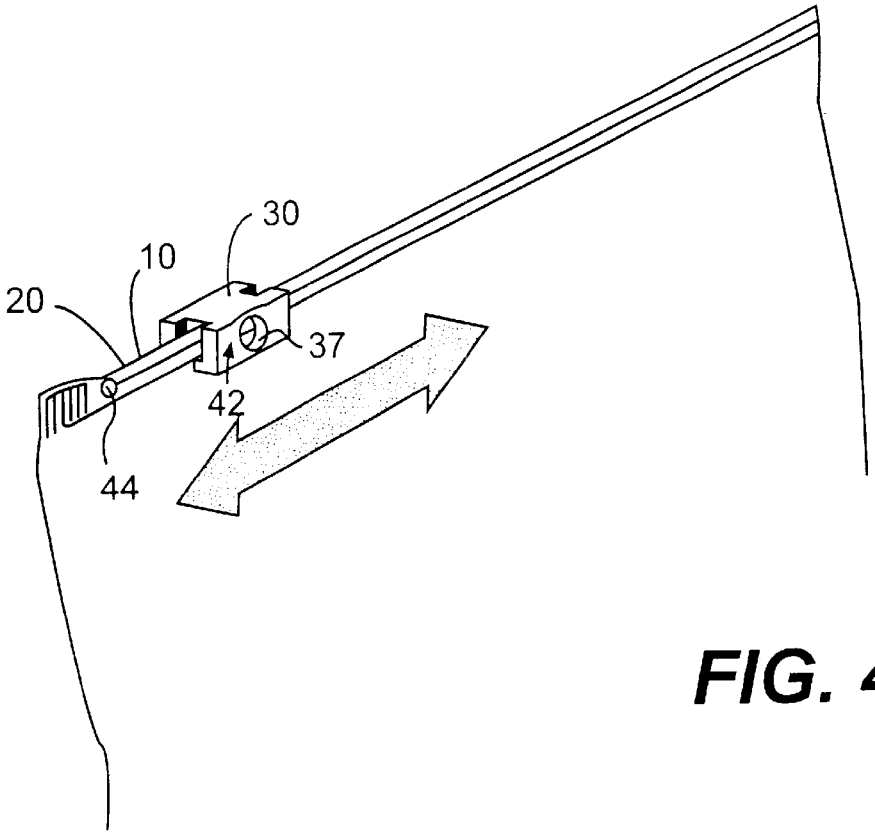
FIG. 4A is a partial perspective view of a thermoplastic bag employing a reclosable fastener assembly according to another embodiment of the present invention.
Figure 4B:
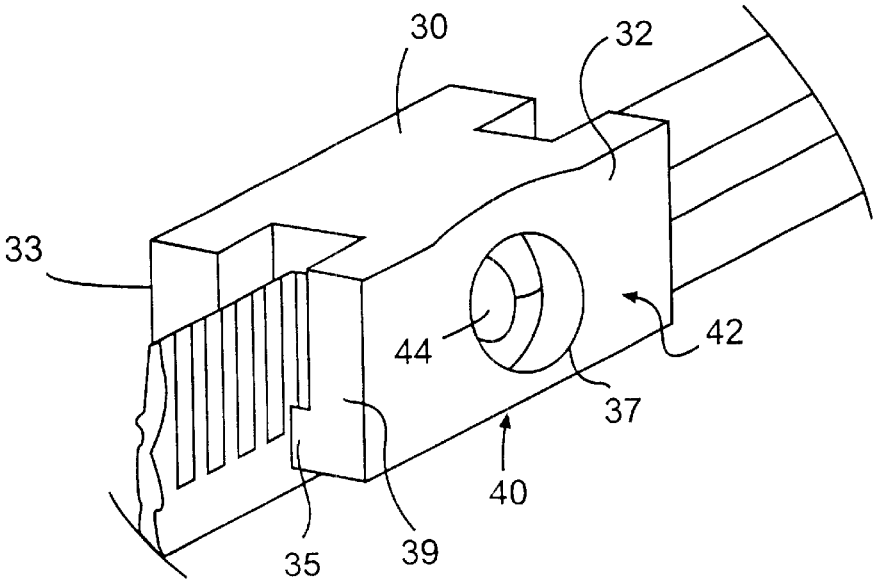
FIG. 4B is a detailed perspective view of an aspect of the fastener assembly illustrated in FIG. 4A, in a closed position.

In another embodiment, illustrated in FIGS. 4A and 4B, the slider 30 includes an opening 37 through which a surface of the closure elements 10, 20 can be viewed. The opening 37 can be located so that the closure elements 10, 20 are visible therethrough. Alternatively, the slider 30 can extend above or below the closure elements 10, 20, and the opening 37 can be positioned so that a different part of the fastener assembly 1 or bag 50 is visible therethrough. The opening 47 can be formed in any suitable manner. For example, if the slider is injection molded, the opening 47 can be formed during molding, in a post-mold operation (e.g., drilling), or by some combination of the two.

The slider 30 and opening 37 provide the first partial indicator 42. The second partial indicator 44 is a feature of the fastener assembly or bag that is located so as to be visible through the opening 37 of the slider 30 when the slider 30 is in its closed position. The second partial indicator 44 is positioned on the closure elements 10, 20, a different part of the fastener assembly 1, or the bag 50, depending on the location of the opening 37 of the slider 30 when the slider 30 is in its closed position. For example, the second partial indicator 44 can be a colored spot, pattern, icon, symbol, letter, word or the like that is provided on or is visible through an outer surface of one of the closure elements 10, 20. The second partial indicator 44 can be formed in any suitable manner, such as, for example, ink jet printing, contact printing, embossing, or the like.

If desired, openings 37 can be provided on each side 32, 33 of the slider 30, and corresponding second partial indicators 44 can be provided on each side of the bag.

Alternatively, multiple openings 37 can be provided on either or both sides 32, 33 of the slider 30, and corresponding second partial indicators 44 can be provided. In one arrangement, the slider 30 can include, as part of the first partial indicator 42, a portion of a pattern interspersed with and interrupted by the openings 37. The second partial indicator 44 can be a complementary portion of the pattern located so as to be visible through the openings 37 when the slider 30 is in its closed position. This arrangement has similarities to the embodiments discussed with reference to FIGS. 1A–3B, in that their first and second partial indicators 42, 44 comprise complementary portions of a pattern, and similarities to the embodiment discussed with reference to FIGS. 4A and 4B, in that visual indicator 40 is formed by aligning openings in the slider 30 with a visible feature of the fastener assembly 1.

In one example (not illustrated), the first partial indicator 42 on the slider 30 includes the word "CLOSED" printed thereon, except that a pair of the openings 37 is provided in place of the letters "O" and "E", respectively. The second partial indicator 44 is the word "OPEN" located so as to be visible when the slider 30 is not in its closed position and so as to be obscured when the slider 30 is in its closed position. The letters "O" and "E" of the word "OPEN" can be located so as to be visible through the openings 37 of the slider 30, thus completing the word "CLOSED" to form the visual indicator 40. Of course, other words or patterns can be used.

In yet another embodiment (not illustrated), the first partial indicator 42 is provided by a slider 30 that is see-through and color tinted. The second partial indicator 44 can be an underlying pattern in one color that is overlayed (and obscured) by a second color. The second partial indicator 40 is visible through the slider 30 when the slider 30 is in its closed position. The colors of the slider 30 and the second partial indicator 44 are chosen so that the second color is filtered by the slider 30 so that the underlying pattern becomes visible through the slider 30 to form the visible indicator 40. In a preferred version, the second color is provided in an overlying pattern. The user will know that the overlying pattern indicates that the fastener assembly is open, while the underlying pattern indicates closed (such as, for example, the word "CLOSED").

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

INDUSTRIAL APPLICABILITY

Fastener assemblies according to the present invention are particularly useful as resealable closures for thermoplastic bags. Such a fastener assembly provides ease of use by virtue of its employment of a slider to assist in opening and closing the fastener assembly. It also provides the user with a simple visual indication as to whether the slider is in its closed position.

We claim:

1. A reclosable bag fastener assembly, comprising:

first and second elongated closure elements engageable to form a seal;

a slider slidable relative to the closure elements between an open position and a closed position and being adapted (i) to engage the closure elements to one another when moved across the closure elements toward the closed position and (ii) to disengage the closure elements from one another when moved across the closure elements toward the open position;

a first partial indicator carried by the slider; and a second partial indicator located relative to the closure elements so as to complement the first partial indicator to form a visual indicator when the slider is in the closed position.

2. The fastener assembly according to claim 1, wherein the second partial indicator is stationary relative to the closure elements.

3. The fastener assembly according to claim 1, wherein the second partial indicator is located near an end of the closure elements.

4. The fastener assembly according to claim 1, wherein the first and second partial indicators comprise complementary portions of a pattern.

5. The fastener assembly according to claim 4, wherein the pattern comprises a word.

6. The fastener assembly according to claim 5, wherein the first and second partial indicators include complementary portions of an individual letter of the word.

7. The fastener assembly according to claim 4, wherein the pattern depicts an object.

8. The fastener assembly according to claim 4, wherein the pattern is three-dimensional.

9. The fastener assembly according to claim 1, further comprising a stop disposed so that the slider abuts the stop when the slider is in the closed position, wherein the second partial indicator is provided on the stop.

10. The fastener assembly according to claim 1, wherein the slider includes an opening through a side of the slider, and wherein the second partial indicator comprises a visible feature that is located so as to be visible through the opening of the slider when the slider is in the closed position.

11. The fastener assembly according to claim 10, wherein a pair of the openings is provided, one each through opposite sides of the slider, and a pair of the visible features is provided, each located so as to be visible through a different one of the pair of the openings of the slider when the slider is in the closed position.

12. The fastener assembly according to claim 10, wherein the feature is provided on the surface of one of the closure elements.

13. A reclosable bag fastener assembly for selectively closing a mouth of a thermoplastic bag, the fastener assembly comprising:

first and second elongated closure profiles disposed on opposing surfaces of the mouth of the bag, the first and second closure profiles being interlockable to seal the mouth of the bag;

a slider bracketing the closure profiles, the slider being slidable relative to the closure profiles between an open position and a closed position and being adapted (i) to interlock the closure profiles when moved across the closure profiles toward the closed position and (ii) to disengage the closure profiles from one another when moved across the closure profiles toward the open position;

a first partial indicator carried by the slider; and a second partial indicator disposed relative to the closure profiles so as to combine with the first partial indicator to form a visual indicator when the slider is in the closed position.

14. The fastener assembly according to claim 13, wherein the second partial indicator is stationary relative to the closure profiles.

15. The fastener assembly according to claim 13, wherein the second partial indicator is located near an end of the closure profiles.

16. The fastener assembly according to claim 13, wherein the first and second partial indicators comprise complementary portions of a pattern.

17. The fastener assembly according to claim 16, wherein the pattern comprises a word.

18. The fastener assembly according to claim 17, wherein the first and second partial indicators include complementary portions of an individual letter of the word.

19. The fastener assembly according to claim 16, wherein the pattern depicts an object.

20. The fastener assembly according to claim 16, wherein the pattern is three-dimensional.

21. The fastener assembly according to claim 13, further comprising a stop disposed so that the slider abuts the stop when the slider is in the closed position, wherein the second partial indicator is provided on the stop.

22. The fastener assembly according to claim 13, wherein the slider includes an opening through a side of the slider, wherein the second partial indicator comprises a visible feature that is located so as to be visible through the opening of the slider when the slider is in the closed position.

23. The fastener assembly according to claim 22, wherein a pair of the openings is provided, one each through opposite sides of the slider, and a pair of the visible features is provided, each located so as to be visible through a different one of the pair of the openings of the slider when the slider is in the closed position.

24. The fastener assembly according to claim 22, wherein the feature is provided on the surface of one of the closure profiles.

* * * * *

UNITED STATES PATENT AND TRADEMARK OFFICE

CERTIFICATE OF CORRECTION

PATENT NO. : 6,442,804 B2
DATED : September 3, 2002
INVENTOR(S) : Robert R. Turvey et al.

It is certified that error appears in the above-identified patent and that said Letters Patent is hereby corrected as shown below:

Title page,
Item [75], Inventors, replace "Jeffrey J. Christensen" with -- Jeffrey J. Christianson --

Signed and Sealed this

Eleventh Day of January, 2005

JON W. DUDAS
*Director of the United States Patent and Trademark Office*